United States Patent [19]

Honegger

[11] 4,388,015

[45] Jun. 14, 1983

[54] DRAINAGE DEVICE EMBEDDED IN A CONCRETE SLAB FOR MOISTURE DRAINAGE

[75] Inventor: Heinz Honegger, Wil, Switzerland

[73] Assignee: Honel Holding AG, Ltd., SA, Rorbas, Switzerland

[21] Appl. No.: 320,182

[22] Filed: Nov. 12, 1981

[51] Int. Cl.[3] ..... E01F 5/00; E03F 1/00

[52] U.S. Cl. ..... 404/2; 210/164; 404/4

[58] Field of Search ..... 404/2, 3, 4, 71, 72; 210/163, 164, 165, 166

[56] References Cited

U.S. PATENT DOCUMENTS

| | | | |
|---|---|---|---|
| 1,252,548 | 1/1918 | Carlson | 210/163 |
| 1,805,816 | 5/1931 | Fleming | 210/165 X |
| 2,025,814 | 12/1935 | Goss | 210/163 X |
| 2,101,978 | 12/1937 | Boosey | 210/165 X |
| 2,148,773 | 2/1939 | Ozias | 404/2 |
| 2,672,205 | 3/1954 | McDonald | 210/163 X |
| 3,670,894 | 6/1972 | Friedl | 210/164 |
| 4,034,428 | 7/1977 | Jacuzzi | 210/166 X |

*Primary Examiner*—Nile C. Byers, Jr.
*Attorney, Agent, or Firm*—Thomas W. Speckman

[57] ABSTRACT

A drainage device for drainage of moisture which collects between a waterproof isolating layer applied to the top surface and a concrete slab itself and/or moisture which passes through a surface layer deposited on top of the isolating layer. The drainage device has a drainpipe extending through the concrete slab and having at its upper end a shallow funnel provided on its upper surface with radially extending grooves and being flush with the top surface of the concrete slab. The funnel is fitted on its underside with a centering cuff concentrically surrounding the funnel tube spatially separating the funnel tube from the drainpipe, the diameter of the funnel tube being at least about 20% smaller than the inner diameter of the drainpipe. The upper end of the funnel opening is covered with a mushroom shaped insert resting on the top of the isolating layer and having radially extending grooves on its underside. The bottom end of the drainpipe has an outlet member supported in the concrete slab in such a manner as to be flush with the underside of the slab and has two concentric drip collars. The drainage device of this invention reduces clogging due to accumulation of lime deposits and reduces long icicles forming at the outlets of such prior art drainpipes.

4 Claims, 7 Drawing Figures

Fig.3
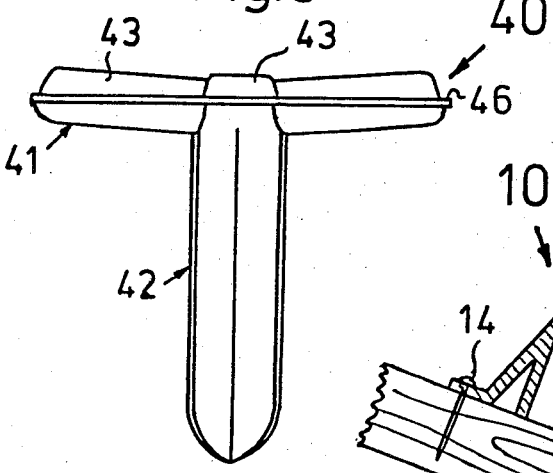
Fig.6
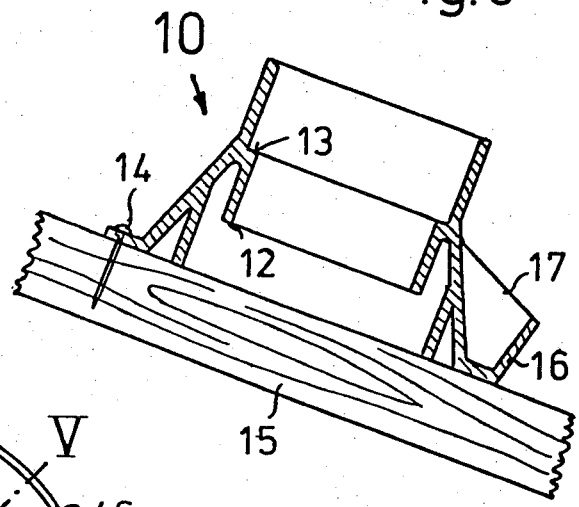
Fig. 4
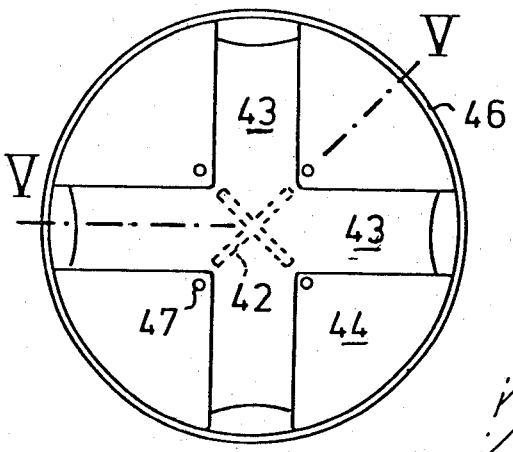
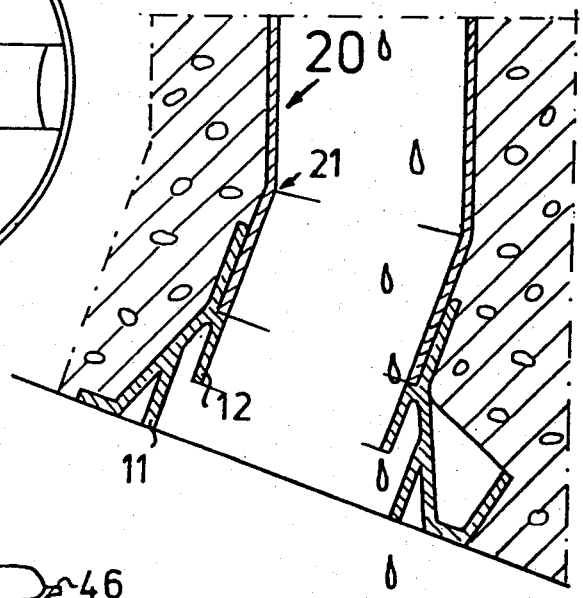
Fig.5
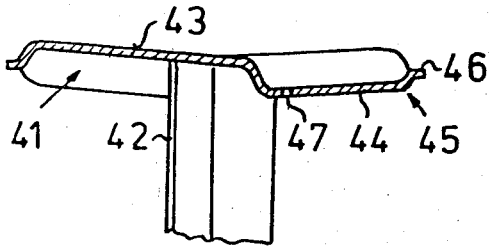
Fig.7

DRAINAGE DEVICE EMBEDDED IN A CONCRETE SLAB FOR MOISTURE DRAINAGE

BACKGROUND OF THE INVENTION

The present invention relates to a device embedded in a concrete slab to drain moisture which accumulates between a watertight isolating layer applied to the concrete slab and the surface of the concrete slab proper, and/or moisture which permeates a surface layer deposited on top of the isolating layer. The device comprises a drainpipe which is embedded in the concrete and into the open upper end of which a shallow funnel is inserted in a manner as to be flush with the upper surface of the concrete slab. The upper portion of the funnel is provided with radially extending grooves and the funnel opening is covered with a mushroom shaped insert or liner resting on the isolating layer and having radially extending grooves in its underside. The lower end of the drainpipe is supported in an outlet or discharge socket installed in the concrete slab so as to be flush with the underside thereof. The outlet socket is provided with a drip collar.

The field of use for such drainage devices is primarily in civil engineering, particularly in bridges and overpasses. The layer deposited on top of the isolating layer is then in most cases a roadway surface layer.

Drainage devices are disclosed in German published patent application DE-OS 21 35 314. In actual practice, however, it has been found that the disclosed device has severe disadvantages. The drawing of the published patent application shows water drops which fall in an exactly centralized relation to the drainpipe. Such theoretical assumption, however, has proven erroneous as practical experience has shown. Rather, the water runs from the outer edge of the funnel-shaped insert down into the funnel tube along the interior wall surface. The water is not conducted from the wall surface over the supporting ribs of the stem to the top or cap of the mushroom shaped cover. Due to the surface tension of the water and the vibrations of the bridge caused by the traffic rolling over it, the minimal gap between the inner wall surface of the annular groove and the interior wall surface of the drainpipe is quickly bridged, favoring the run-off of the water down the inner wall surface of the drainpipe. The consequences, particularly the obstruction of the pipes by lime deposits, are all too familiar. In winter, long hazardous icicles form at the outlets of such drainpipes.

SUMMARY OF THE INVENTION

The drainage device according to the present invention is comprised of a drainpipe (20) extending through a concrete slab (B) and provided with a funnel (30). The tube (33) of the funnel (30) is spatially centered with respect to the drainpipe (20) by means of a centering cuff (32). The drainpipe (20) merges at its lower end into an outlet member (10) having two drip collars (11, 12). The outlet (10) is adapted to be fitted with a pipe extension (50) which connects with a collecting pipe (51). The collecting pipe (51) is accessible through a cleaning flange (52).

Water seeping through the road surface layer (S) is caused to run off through a mushroom shaped insert (40) having ribs (42) arranged on its stem which abut the inner wall surface of the tube (33) of the funnel (30).

The device is particularly suitable for installation in bridges.

The object of the present invention is to eliminate disadvantages of prior art drainage devices. This is accomplished by the following features:

1. Narrowing of the funnel tube with respect to the drainpipe.
2. Providing a centering cuff to aid in the exact placement of the funnel tube with respect to the interior wall surface of the drainpipe.
3. A drip rim at the discharge end of the funnel tube.
4. A diameter of the funnel tube which is approximately 20% smaller than the inner diameter of the drainpipe.
5. Two drip collars on the outlet socket.

The inventive novelty over the prior art provides improvement in water drainage technology.

BRIEF DESCRIPTION OF THE DRAWING

The drawing illustrates an exemplary embodiment of the invention wherein:

FIGS. 3 and 4 are enlarged side and top views, respectively, of the mushroom shaped insert shown in FIG. 1;

FIG. 5 is a sectional view along the line V—V in FIG. 4; and

FIGS. 6 and 7 illustrate in an enlarged view the installation and mode of operation of the outlet or discharge member in another embodiment of this invention.

DESCRIPTION OF PREFERRED EMBODIMENTS

Figure 1:
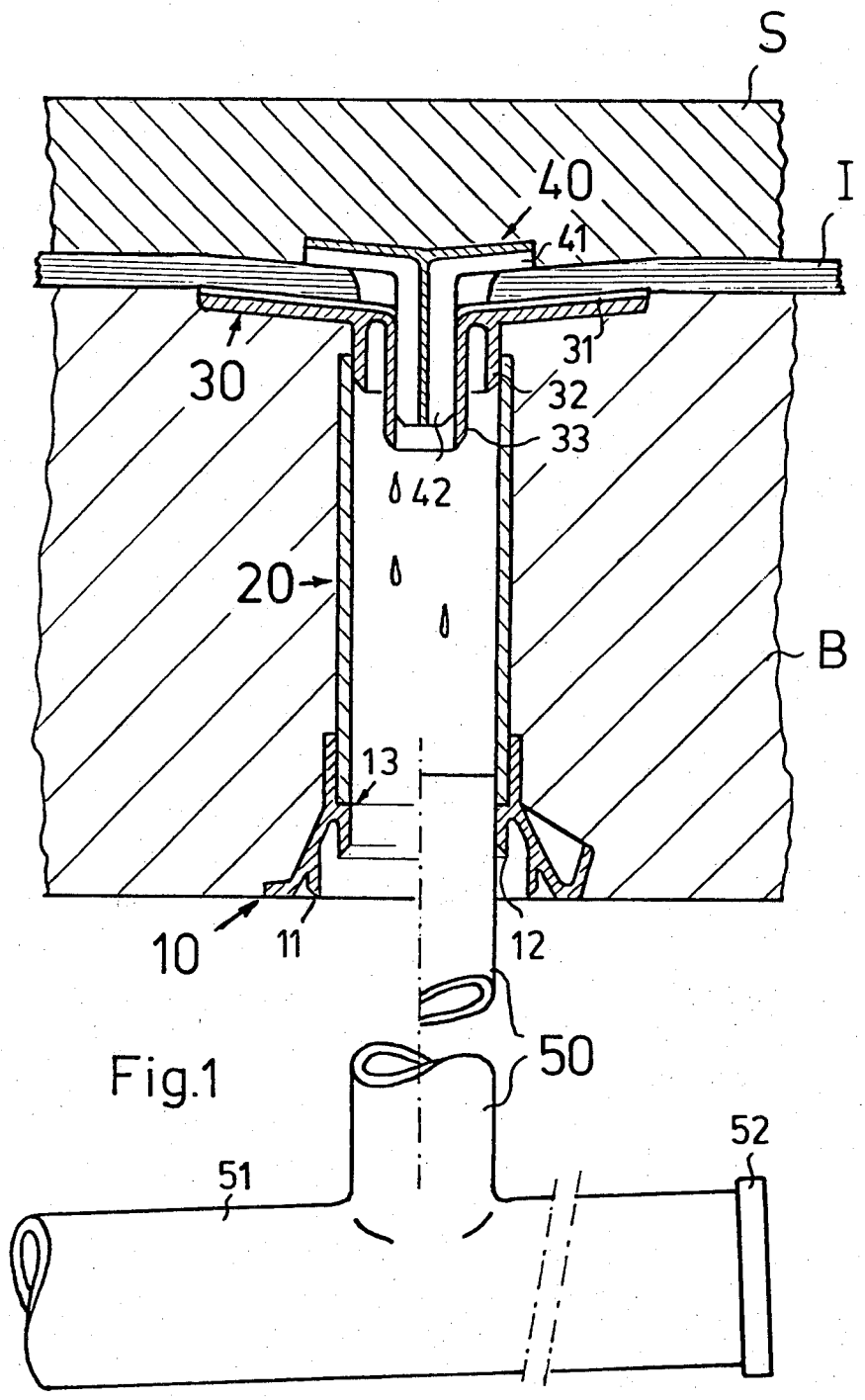
FIG. 1 is a partial sectional view of the drainage device according to one embodiment of this invention.

Referring to FIG. 1, a concrete slab B is provided with an isolating waterproof layer I, on top of which is deposited a roadway layer S. During the casting of the concrete, outlet member 10 rests on the forming and provides a support for drainpipe 20. Inserted into the upper opening of drainpipe 20 is shallow funnel 30. During the pouring of the concrete, funnel 30 may be closed by a plug or stopper (not illustrated) to prevent concrete mix from flowing into the funnel or the pipe. When the concrete casting operation is completed, waterproof isolating layer I is applied and then mushroom shaped insert 40 is placed through isolating layer I.

Outlet structure 10 is provided with two annular drip collars 11 and 12. The inner collar is bevelled so that an extension pipe may readily be attached thereto. It is also possible for collar 12 to slidably receive a pipe whose inner diameter corresponds to the outer diameter of the collar 12. A ledge 13 inside socket or outlet member 10 serves to support drainpipe 20.

The shallow funnel 30 has radially extending grooves 31 on its top surface for moisture to collect in and run off, such moisture forming between the concrete slab B and isolating layer I.

The mushroom shaped insert 40 is provided on the underside of its cap portion with radially extending grooves 41, while its stem portion is provided with ribs 42.

Funnel 30 is fitted with a centering cuff or extending liner 32 to aid in the accurate centering of the funnel as it is being inserted into the top opening of the drainpipe 20. The height of cuff 32 permits funnel 30 to be exactly flush with the top surface of the concrete slab B. Discharge tube 33 of funnel 30 is provided at its bottom end with a drip rim. Since the outer diameter of funnel tube 33 is considerably smaller, i.e., by at least about 20%, than the inner diameter of drainpipe 20, no drops of moisture will come into contact with the wall of the drainpipe.

By attaching to drainpipe 20 an extension pipe 50, which connects with a collecting pipe 51, any possible influence of adverse weather conditions is eliminated, and the effect of freezing temperatures is certainly lessened as compared to an open drainpipe.

Since calcium containing drops of moisture may cause lime deposits in the collecting pipe 51 during the course of years, it is desirable to fit the collecting pipe with an attachment to facilitate cleaning, as it is indicated by removable end 52 in the lower right hand corner of FIG. 1.

Figure 2:
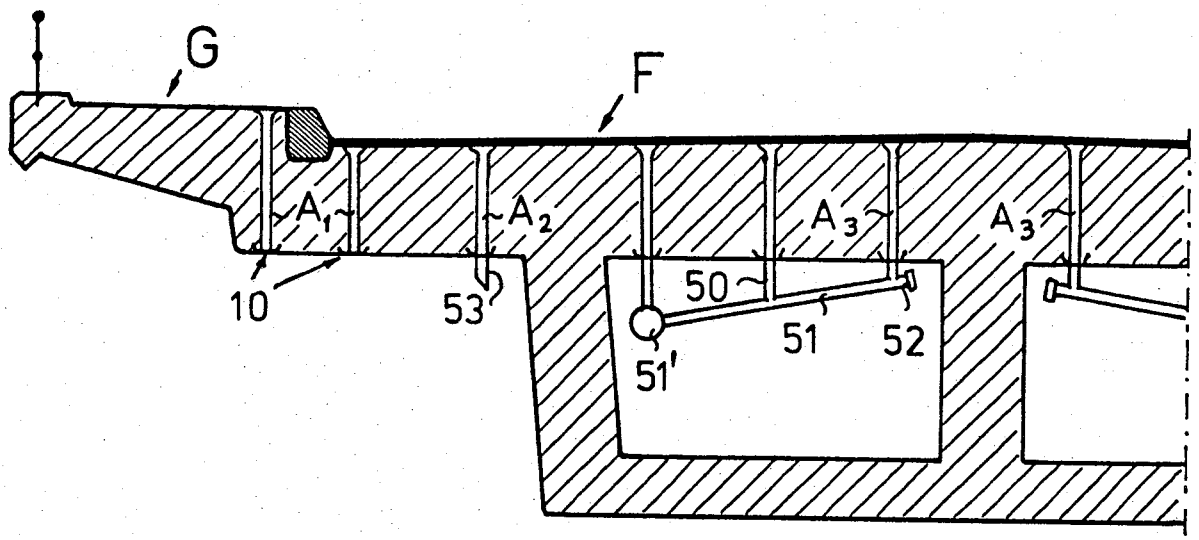
FIG. 2 illustrates typical installations of drainage devices of this invention in bridge construction.

FIG. 2 illustrates some applications of the drainage device according to the invention in conjunction with a bridge structure. The middle section of the bridge, including the roadway F, is constructed in the form of a box with laterally projecting beams. The two outwardly projecting sections carry walkways G.

The extreme left hand beam section is provided with drainage devices $A_1$ the lower ends of which are flush with the underside of the concrete slab. The drainpipe $A_2$ is fitted with an extension pipe 53, the lower edge of which is slanted to form an extended drip nose. The pipe section 53 reduces somewhat the effect of the wind and prevents drops from being blown against the concrete beam. In the interior of the hollow core slab or beam structure, the drain pipes A3 are fitted with pipe extensions 50 which connect with collecting pipes 51 extending transversely to the longitudinal bridge axis and connect with collecting pipes 51 extending parallel to the longitudinal axis of the bridge.

FIGS. 3–5 illustrate mushroom shaped insert 40 in greater detail. Grooves 41 are in the form of four radial, tunnel-shaped raised sections covered by top structure 43. The surface areas 44 between the tunnel-shaped raised sections are bent upward at their outer edges 45 to form rim 46. In this fashion, a molded plastic unit of approximately uniform wall thickness may be used. The surface areas 44 slope inwardly to conform to the shape of the funnel and at their lower points are provided with drainage holes 47. The sectional profile of stem 42 is that of a cross.

The rounded edge 45 on the outer side of surface area 44 aids in the improved drainage of the water which collects on the isolating layer I, while holes 47 facilitate the run-off of the water which penetrates the road layer S directly above insert 40.

FIGS. 6 and 7 illustrate the outlet member 10 in greater detail. FIG. 6 shows how the bottom flange may be secured by nails 14 in the desired position to the wood forming 15. For this purpose, the upwardly extending collar 16 is notched in four places and is braced by ribs. The collar and ribs serve to anchor the unit in the concrete. After removal of the forming, the projecting portions of the nails 14 are cut off. FIGS. 6 and 7 illustrate the outlet member 10 in an inclined position, as may actually be the case on the slanting underside of a bridge structure (see FIG. 2). The plastic drainpipe 20 is correspondingly bent or cut at an angle and connected at 21.

The drops of moisture shown in FIG. 7 illustrate that also in this inclined position the drops will not run down the outer surface of the concrete, but will drip off from rim 12 or, alternatively, rim 11.

I claim:

1. A device embedded in a concrete slab for drainage of moisture which collects between a waterproof isolating layer (I) applied to the top surface and the concrete slab itself, and/or moisture which passes through a layer (S) deposited on the top of said isolating layer, said drainage device comprising; a drainpipe (20) embedded in said concrete slab (B) and having its upper end fitted with a shallow funnel (30) provided on its upper surface with radially extending grooves (31) and is flush with the top surface of said concrete slab, the upper end of the funnel opening being covered with a mushroom shaped insert (40) resting on said isolating layer, said insert having on its underside radially extending grooves (41), the bottom end of said drainpipe being supported in an outlet member (10) installed in said concrete slab in such a manner as to be flush with the underside thereof, said funnel (30) fitted on its underside with a centering cuff (32) concentrically surrounding tube (33) of said funnel (30) and spatially separating said tube (33) from said drainpipe (20), the diameter of said funnel tube (33) being at least about 20% smaller than the inner diameter of said drainpipe (20) to prevent dripping water from coming into contact with the interior wall of said drainpipe (20), and said outlet member (10) on the lower end of said drainpipe (20) having two concentric drip collars (11, 12).

2. The device of claim 1 wherein said outlet member is adapted to receive an extension pipe (50) extending beyond said concrete slab (B).

3. The device of claim 2 wherein said extension pipe (50) connects at its bottom end with a collecting pipe (51) serving a plurality of said extension pipes.

4. The device of claim 3 wherein said collecting pipe (51) has a cleanout means (52) at one end.

* * * * *